US008892007B2

(12) United States Patent
Takane et al.

(10) Patent No.: US 8,892,007 B2
(45) Date of Patent: Nov. 18, 2014

(54) IMAGE FORMING APPARATUS, TONER SUPPLYING METHOD, AND COMPUTER PROGRAM PRODUCT

(75) Inventors: Toshiaki Takane, Osaka (JP); Naoki Nakatake, Hyogo (JP); Tomohiro Kubota, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 294 days.

(21) Appl. No.: 13/422,286

(22) Filed: Mar. 16, 2012

(65) Prior Publication Data

US 2012/0237227 A1 Sep. 20, 2012

(30) Foreign Application Priority Data

Mar. 16, 2011 (JP) ..... 2011-058264

(51) Int. Cl.
*G03G 15/08* (2006.01)
*G03G 15/00* (2006.01)

(52) U.S. Cl.
CPC ..... *G03G 15/0877* (2013.01); *G03G 15/556* (2013.01); *G03G 2215/0888* (2013.01)
USPC ..... 399/260; 399/27

(58) Field of Classification Search
CPC ..... G03G 15/556; G03G 15/0877; G03G 15/0888
USPC ..... 399/27, 260
See application file for complete search history.

(56) References Cited

U.S. PATENT DOCUMENTS

| | | | | | |
|---|---|---|---|---|---|
| 4,969,011 | A * | 11/1990 | Faull et al. | 399/58 |
| 5,150,135 | A * | 9/1992 | Casey et al. | 347/125 |
| 5,826,134 | A * | 10/1998 | Hino et al. | 399/27 |
| 2004/0001725 | A1 * | 1/2004 | Onishi | 399/55 |
| 2007/0091390 | A1 * | 4/2007 | Kimura et al. | 358/500 |
| 2008/0253781 | A1 * | 10/2008 | Takezawa | 399/39 |
| 2009/0290885 | A1 * | 11/2009 | Maruyama | 399/27 |

FOREIGN PATENT DOCUMENTS

| | | | |
|---|---|---|---|
| JP | 05297720 | A * | 11/1993 |
| JP | 3220256 | | 8/2001 |
| JP | 2003005503 | A * | 1/2003 |
| JP | 2008158373 | A * | 7/2008 |

* cited by examiner

*Primary Examiner* — David Gray
*Assistant Examiner* — Tyler Hardman
(74) *Attorney, Agent, or Firm* — Oblon, Spivak, McClelland, Maier & Neustadt, L.L.P.

(57) ABSTRACT

A control unit drives a driving unit for a correction driving time to supply toner to a developing unit from a toner supplying unit, when a detecting unit detects that an amount of toner stored in the developing unit is equal to or less than a threshold value. A calculating unit calculates an amount of toner consumption from when the toner is supplied to the developing unit to when the detecting unit detects that the amount of the toner stored in the developing unit is equal to or less than the threshold value. The control unit calculates a unit amount of toner supply from the correction driving time and the amount of toner consumption, and supplies the toner to the developing unit by driving the driving unit on the basis of the calculated unit amount of toner supply.

7 Claims, 6 Drawing Sheets

IMAGE FORMING APPARATUS, TONER SUPPLYING METHOD, AND COMPUTER PROGRAM PRODUCT

CROSS-REFERENCE TO RELATED APPLICATIONS

The present application claims priority to and incorporates by reference the entire contents of Japanese Patent Application No. 2011-058264 filed in Japan on Mar. 16, 2011.

BACKGROUND OF THE INVENTION

1. Field of the Invention

The present invention relates to an image forming apparatus, a toner supplying method, and a computer program product.

2. Description of the Related Art

In an electrophotographic image forming apparatus, there is a need to keep an amount of toner in a developing unit at a constant level. This is because an excessive low amount of toner may cause a blurring or uneven density in the print image, and an excessive high amount of toner may cause a degradation of toner. Therefore, it is required for this type of image forming apparatus to accurately supply an appropriate amount of toner, which is complementary with a toner consumption in the image forming process, from a toner bottle or the like to the developing unit.

For example, Japanese Patent Application Laid-open No. H05-297720 discloses a technology for calculating an engaging time of a toner supply clutch (so-called "clutch ON time") required to supply an appropriate amount of toner, commensurate with the toner consumption, on the basis of an estimation of the toner consumption and a signal from a sensor, and supplying the toner by driving the toner supply clutch for the calculated engaging time.

However, there is ordinary seen variations or differences among products such as the toner supplying unit that supplies the toner to the developing unit or the driving unit for the toner supplying unit. Therefore, the amount of toner supply varies among products, even if the toner is supplied to the developing unit by driving the driving unit for the same time. Thus, it is difficult to supply the required amount of toner accurately.

SUMMARY OF THE INVENTION

It is an object of the present invention to at least partially solve the problems in the conventional technology.

An image forming apparatus is provided with an image carrying body on which an electrostatic latent image is formed, a developing unit that stores toner to develop the electrostatic latent image formed on the image carrying body by using the toner stored therein, a detecting unit that detects whether an amount of the toner stored in the developing unit is equal to or less than a threshold value, a control unit that drives a driving unit for a correction driving time to supply the toner to the developing unit from a toner supplying unit, when the detecting unit detects that the amount of the toner stored in the developing unit is equal to or less than the threshold value, and a calculating unit that calculates an amount of toner consumption from when the toner is supplied to the developing unit to when the detecting unit detects that the amount of the toner stored in the developing unit is equal to or less than the threshold value. The control unit calculates a unit amount of toner supply which corresponds to an amount supplied in a case of driving the driving unit for a unit driving time, from the correction driving time and the amount of toner consumption, and supplies the toner to the developing unit from the supplying unit by driving the driving unit on the basis of the calculated unit amount of toner supply.

A toner supplying method includes developing an electrostatic latent image formed on an image carrying body by using toner stored in a developing unit, detecting whether an amount of the toner stored in the developing unit is equal to or less than a threshold value, firstly supplying the toner to the developing unit from a toner supplying unit by driving a driving unit for a correction driving time, when it is detected that the amount of the toner stored in the developing unit is equal to or less than the threshold value, calculating an amount of toner consumption from when the toner is supplied to the developing unit to when it is detected that the amount of the toner stored in the developing unit is equal to or less than the threshold value, and secondarily supplying the toner to the developing unit from the supplying unit by calculating a unit amount of toner supply which corresponds to an amount supplied in a case of driving the driving unit for a unit driving time, from the correction driving time and the amount of toner consumption, and driving the driving unit on the basis of the calculated unit amount of toner supply.

A computer program product includes a non-transitory computer-readable medium having computer-readable program codes embedded therein for controlling a toner supplying by a computer, the program codes when executed causing the computer to execute developing an electrostatic latent image formed on an image carrying body by using toner stored in a developing unit, detecting whether an amount of the toner stored in the developing unit is equal to or less than a threshold value, firstly supplying the toner to the developing unit from a toner supplying unit by driving a driving unit for a correction driving time, when it is detected that the amount of the toner stored in the developing unit is equal to or less than the threshold value, and calculating an amount of toner consumption from when the toner is supplied to the developing unit to when it is detected that the amount of the toner stored in the developing unit is equal to or less than the threshold value, and secondarily supplying the toner to the developing unit from the supplying unit by calculating a unit amount of toner supply which corresponds to an amount supplied in a case of driving the driving unit for a unit driving time, from the correction driving time and the amount of toner consumption, and driving the driving unit on the basis of the calculated unit amount of toner supply.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE INVENTION

Hereinafter, an image forming apparatus and a toner supplying method according to an embodiment will be described with reference to the accompanying drawings. In the following embodiment, an explanation will be made on an electrophotographic color printer, specifically, a color printer for forming images of four colors of yellow Y, magenta M, cyan C and black K, as an example of an image forming apparatus according to the embodiment. However, the embodiment is not limited thereto. The image forming apparatus according to the embodiment may be applied to a facsimile machine, a copying machine, an MFP (Multifunction Peripheral), and the like, so long as it forms an image in an electrographic method regardless of color or monochrome. Incidentally, the MFP means an apparatus that has at least two functions from among a printing function, a copying function, a scanning function, and a facsimile function.

First, the configuration of the printer according to the embodiment will be described.

Figure 1:
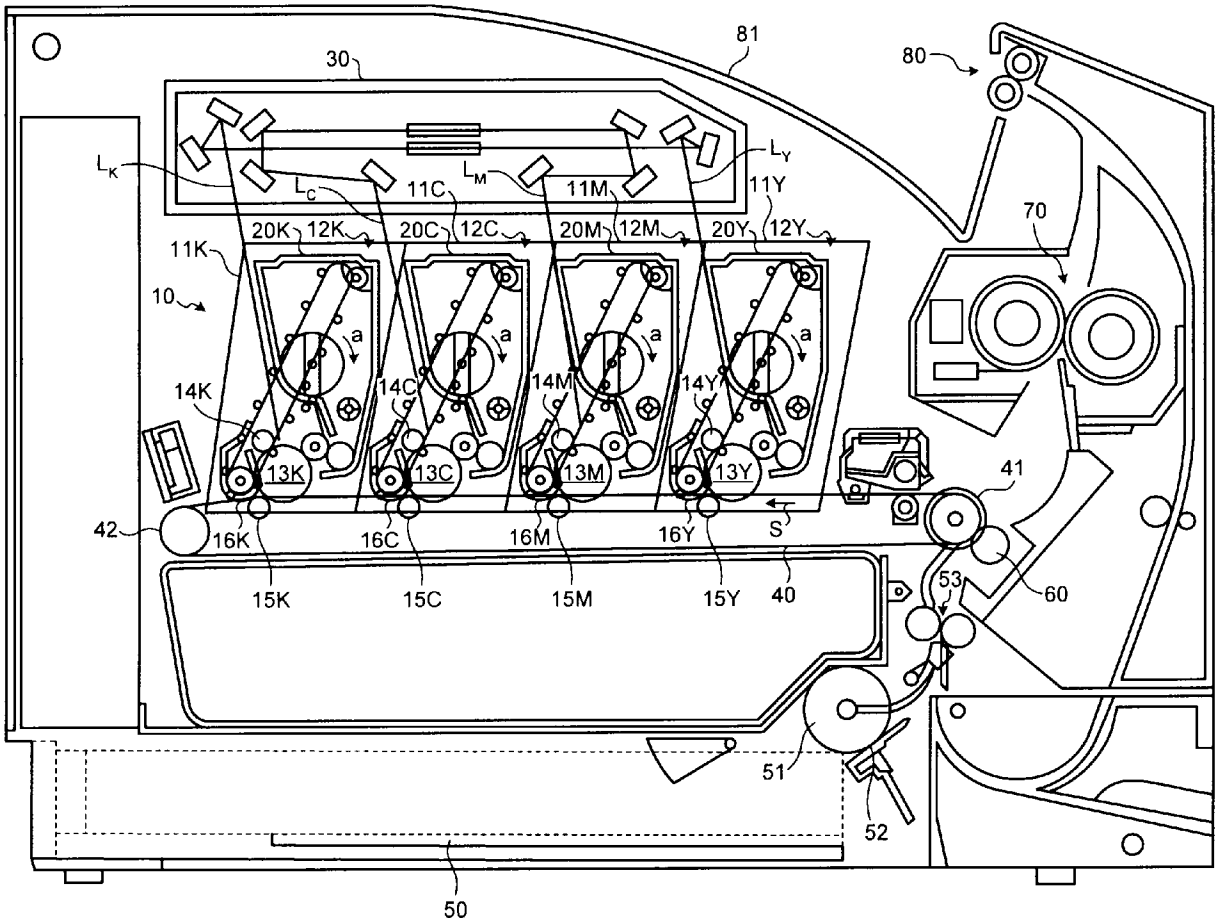
FIG. 1 is a mechanical configuration diagram illustrating an example of a printer according to an embodiment.

FIG. 1 is a mechanical diagram showing an example of the printer 1 according to the embodiment. As shown in FIG. 1, the printer 1 is provided with an image forming unit 10, an optical scanning unit 30, an intermediate transfer belt 40, supporting rollers 41, 42, a feeding unit 50, a feeding roller 51, a pad 52, a pair of conveying rollers 53, a secondary transfer roller 60, a fixing unit 70, a pair of ejecting rollers 80, and an ejection tray 81.

The image forming unit 10 is made of process cartridges 11Y, 11M, 11C, and 11K for color yellow, magenta, cyan, and black, respectively. The process cartridges 11Y, 11M, 11C, and 11K include imaging units 12Y, 12M, 12C, and 12K, respectively. As shown in FIG. 1, imaging units 12Y, 12M, 12C, and 12K are arranged along the intermediate transfer belt 40 in this order from the upper stream side with respect to the moving direction of the intermediate transfer belt 40, i.e. a direction indicated by an arrow S. Thus, the printer 1 according to the embodiment is illustrated as a tandem type printer in which imaging units for each color are arranged along the intermediate transfer belt 40. However, the printer 1 is not limited to this example.

The imaging unit 12Y is provided with a photosensitive drum 13Y, a charging roller 14Y, a developing device 20Y, a primary transfer roller 15Y, and a cleaning unit 16Y. The imaging unit 12Y and the optical scanning unit 30 perform an imaging or image forming process (a charging step, an exposing step, a developing step, a transfer step and a cleaning step) on the photosensitive drum 13Y, so that a yellow toner image is formed on the photosensitive drum 13Y and transferred to the intermediate transfer belt 40.

The imaging units 12M, 12C and 12K are all provided with components identical to those of the imaging unit 12Y. The imaging unit 12M forms a magenta toner image by performing the image forming process, the imaging unit 12C forms a cyan toner image by performing the image forming process, and the imaging unit 12K forms a black toner image by performing the image forming process. Thus, the components of the imaging unit 12Y will be mainly described hereinbelow, and descriptions of the imaging units 12M, 12C and 12K having M, C and K attached to reference numerals of the components of the imaging units 12M, 12C and 12K in place of Y attached to reference numerals of the components of the imaging unit 12Y will be omitted. In this embodiment, non-magnetic single component toner is used as the toner, but the present invention is not limited thereto.

The photosensitive drum 13Y is an image carrying body, and is driven and rotated in the direction of an arrow "a" by a photosensitive drum driving unit (not shown).

First, in the charging step, the charging roller 14Y, which abuts the photosensitive drum 13Y, initializes a surface of the photosensitive drum 13Y by uniformly charging the drum surface, while driven and rotated, to a high potential in darkness.

Next, in the exposing step, a light-modulated laser beam $L_Y$ is selectively scanned to expose the charged surface of the photosensitive drum 13Y by the optical scanning unit 30 (an example of an exposing unit), on the basis of image data subjected to an image processing by an image processing unit (not shown) such as ASIC (Application Specific Integrated Circuit). Thus, an electrostatic latent image corresponding to a yellow component image is formed on the surface of the photosensitive drum 13Y. Accordingly, a part or area of the surface of the photosensitive drum 13Y exposed to the scanning laser beam LY becomes a low potential part or area where the electric potential is decayed. This low potential part or area constitutes the electrostatic latent image (image part). On the other hand, a high potential part or area where the laser beam LY is not irradiated and thereby the potential is not decayed constitutes a background part or area. Incidentally, in the embodiment, the optical scanning unit 30 emits the laser beam LY with LEDA (Light Emitting Diode Array) to expose the photosensitive drum 13Y and thereby form the electrostatic latent image. However, the present invention is not limited thereto.

Next, in the developing step, the developing device 20Y develops the electrostatic latent image formed on the photosensitive drum 13Y using yellow toner, and forms a yellow toner image on the photosensitive drum 13Y. Specifically, the developing device 20Y visualizes the electrostatic latent image by transferring the yellow toner to the low-potential part of the photosensitive drum 13Y, so that the yellow toner image is formed on the photosensitive drum 13Y. The developing device 20Y may transfer the yellow toner to the high-potential part of the photosensitive drum 13Y, and form the yellow toner image on the photosensitive drum 13Y.

Then, in the transfer step, a primary transfer roller 15Y transfers the yellow toner image formed on the photosensitive drum 13Y to the intermediate transfer belt 40. After the yellow toner image is transferred, non-transferred toner slightly remains on the photosensitive drum 13Y.

Next, in the cleaning step, the cleaning device 16Y removes the non-transferred toner remaining on the photosensitive drum 13Y.

The intermediate transfer belt 40 is an endless belt extended along and supported by a plurality of rollers including the supporting rollers 41 and 42, and is endlessly moved in the direction of the arrow S when one of the supporting rollers 41 and 42 is driven and rotated. The yellow toner image is first transferred to the intermediate transfer belt 40 by the imaging unit 12Y. Successively, a magenta toner image, a cyan toner image and a block toner image are sequentially overlapped and transferred to the intermediate transfer belt 40 by the imaging units 12M, 12C and 12K, respectively. Accordingly, a full-color toner image is formed on the intermediate transfer belt 40.

A plurality of recording papers or sheets are stacked and accommodated in the feeding unit 50. The feeding roller 51 abuts the uppermost recording sheet in the feeding unit 50 to feed the same. If two or more recording sheets are fed by the feeding roller 51, the pad 52 separates one from them. The pair of conveying rollers 53 conveys the recording sheet fed by the feeding roller 51 in between the support roller 41 and the secondary transfer roller 60 at predetermined timing.

The secondary transfer roller 60 transfers collectively the full-color toner image conveyed by the intermediate transfer belt 40 to the recording sheet conveyed by the pair of conveying rollers 53.

The fixing unit 70 fixes the full-color toner image on the recording sheet by heating and pressing the recording sheet having the full-color toner image transferred thereto.

The pair of ejecting rollers 80 discharges the recording sheet having the full-color toner image fixed thereon by the fixing unit 70 to the ejection tray 81.

Figure 2:
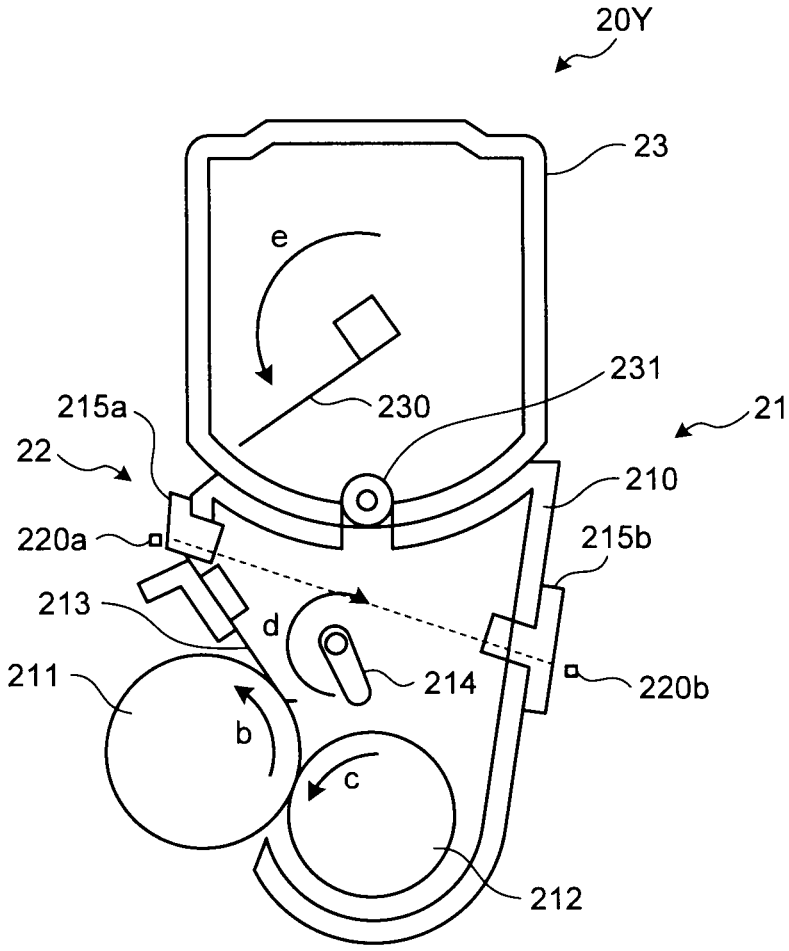
FIG. 2 is a mechanical configuration diagram illustrating an example of a developing unit according to the embodiment.

FIG. 2 is a mechanical diagram illustrating an example of the developing device 20Y according to the embodiment. As illustrated in FIG. 2, the developing device 20Y includes a developing unit 21, a detecting unit 22 and a toner container 23.

The developing unit 21 is used to store the toner and develop the electrostatic latent image on the photosensitive drum 13Y using the stored toner. The developing unit 21 includes a housing 210, a developing roller 211, a supplying roller 212, a developing blade 213, a stirring member 214 and transparent windows 215*a* and 215*b*.

The housing 210 (an example of a storage unit) is a developing tank for storing the toner to be used as a developer, and has an opening at an upper part thereof.

The developing roller 211 is a toner carrying body, and is rotated in the direction of an arrow b in the developing step. Accordingly, the electrostatic latent image on the photosensitive drum 13Y is visualized using the toner. The developing roller 211 has a metal cored bar, and an outer circumference of the metal cored bar is surrounded by conductive rubber (e.g., conductive urethane rubber or silicone rubber) having a volume resistance of about $10^5$ to $10^7\Omega$. In this embodiment, the developing roller 211 has the rubber hardness of 75 [Hs], the cored bar diameter of ϕ6 [mm], and the rubber part outer diameter of ϕ12 [mm]. However, the present invention is not limited thereto.

The supplying roller 212 is a toner supply member, and rotatably abuts the developing roller 211. The supplying roller 212 may be, for example, a sponge roller made of foamed polyurethane, which is mixed with carbon to be semi-conductive, surrounding the outer circumference of the metal bar core. In this embodiment, the supplying roller 212 has the cored bar diameter of ϕ6 [mm], the rubber part outer diameter of ϕ12 [mm], the nip with the developing roller 211 of 2 [mm], and the rotation-number ratio to the developing roller 211 of 1. However, the embodiment is not limited thereto. For example, in this embodiment, the contact nip between the supplying roller 212 and the developing roller 211 may be set to about 1 to 3 mm, and the supplying roller 212 is rotated in the direction of an arrow c with respect to the developing roller 211, so that the toner in the housing 210 can be efficiently conveyed up to a surface layer of the developing roller 211.

The developing blade 213 abuts the developing roller 211, so that the total thickness of the toner on a surface of the developing roller 211 conveyed by the supplying roller 212 is controlled to have a predetermined value, and simultaneously, the toner on the surface of the developing roller 211 is frictionally charged. In this embodiment, the developing blade 213 is made of an SUS material having a plate thickness of 0.1 mm. In the developing blade 213, the linear pressure of the developing blade 213 is 45 N/m, the position of a nip from a front-end is 0.2 mm, and the length (free length) from a support end to a free end is 14 mm. However, the embodiment is not limited thereto. For example, in this embodiment, the developing blade 213 may be configured with a metal plate. The contact pressure of the developing blade 213 against the developing roller 211 generally has a linear pressure of 20 to 60 N/m, and the position of a contact nip is set to about 0.5±0.5 mm from the front-end of the developing blade 213, so that a stable thin layer of toner can be formed on the developing roller 211. However, such values are appropriately determined according to characteristics of the toner, developing roller and supplying roller to be used.

Figure 3:
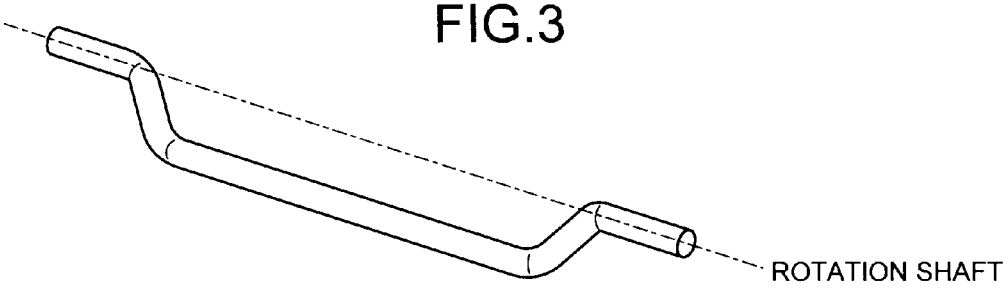
FIG. 3 is a diagram illustrating an example of a stirring member according to the embodiment.
Figure 4:
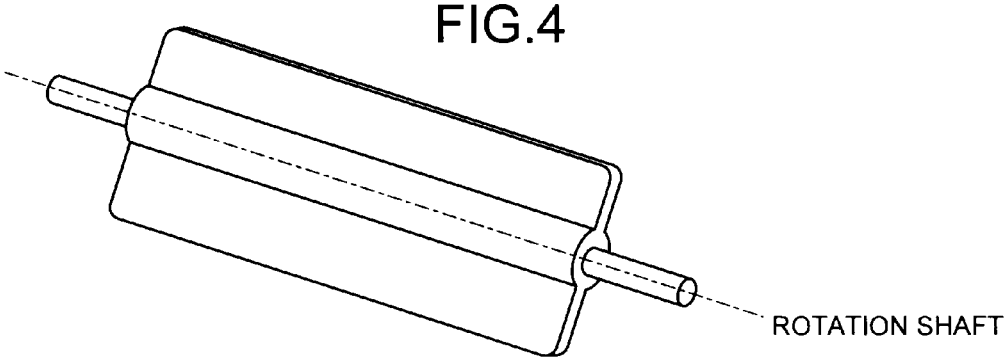
FIG. 4 is a diagram illustrating another example of the stirring member according to the embodiment.

The stirring member 214 is rotated in the direction of an arrow "d" to stir the toner in the housing 210. Accordingly, it is possible to prevent the pressure of toner powder inside the housing 210 from concentrating on the supplying roller 212, and thereby prevent the load to the supplying roller 212 from being enormous. Examples of the stirring member 214 are illustrated in FIGS. 3 and 4. The stirring member 214 may be realized as a paddle obtained by bending both ends of a metal bar with a diameter of approximately ϕ0.8 to 2 [mm] as illustrated in FIG. 3, or a resin paddle obtained by integrally forming a rotation shaft and a wing for stirring toner as illustrated in FIG. 4. Alternatively, the stirring member 214 may be realized by as agitator configured identically to an agitator 230 that is a toner loosening member in a toner container 23 which will be described later.

The transparent windows 215*a* and 215*b* constitute a part of the sidewall of the housing 210, and are disposed opposite to each other.

The detecting unit 22 is a sensor for detecting the amount of toner stored in the developing unit 21, and detects whether the amount of the toner stored in the developing unit 21 is equal to or less than a threshold value. The detecting unit 22 includes a light emitting element 220*a* disposed at a lower side of the transparent window 215*a* and a light receiving element 220*b* disposed at a lower side of the transparent window 215*b*. The light emitting element 220*a* and the light receiving element 220*b* are disposed so that the light emitted from the light emitting element 220*a* passes through the transparent windows 215*a* and 215*b* and is received by the light receiving element 220*b*.

When the toner sufficiently remains in the housing 210, the light emitted from the light emitting element 220*a* is blocked by the toner in the housing 210, and therefore, does not reach the light receiving element 220*b*. However, if the printer 1 repeats a printing operation so that the toner in the housing 210 is consumed, the level surface of the toner in the housing 210 is lowered, and thus light emitted from the light emitting element 220*a* reaches (is received by) the light receiving element 220*b*.

In this embodiment, the amount of toner remaining in the housing 210 at a time point when the light emitted from the light emitting element 220*a* becomes capable of reaching the light receiving element 220*b* is set to a threshold value. Hence, in this embodiment, whether or not the amount of toner remaining in the housing 210 becomes the threshold value can be determined on the basis of whether the light receiving element 220*b* detects the light.

Although it has been described in this embodiment that the detecting unit 22 is realized as an optical sensor, the detecting unit 22 may be realized as a powder detection sensor using a piezoelectric vibration element. Since the powder detection sensor has a detection surface minutely vibrating at all times, the vibration is restricted when the toner contacts the detection surface. Thus, it is possible to detect the presence of the toner.

The toner container 23 (an example of a toner supplying unit) is a container for accommodating toner to be supplied to the developing unit 21, and is attachably/detachably mounted to the upper part of the housing 210. The toner container 23 includes an agitator 230 and a toner supplying roller 231.

The agitator 230 is rotated in the direction of an arrow "e" to stir the toner in the toner container 23. The agitator 230 may be realized, for example, as a member obtained by attaching a sheet-shaped wing to a rotation shaft. The agitator 230 and the toner supplying roller 231 are driven in synchronization with each other.

The toner supplying roller 231 is rotated to supply the toner accommodated in the toner container 23 to the housing 210 through an opening formed at the upper part of the housing 210 in the developing unit 21. Here, the amount of toner supplied from the toner container 23 to the developing unit 21 is determined by a driving time of the toner supplying roller 231. Thus, the amount of toner supplied from the toner container 23 to the developing unit 21 can be controlled by adjusting the driving time of the toner supplying roller 231. When the driving time is lengthened, the supply amount of toner is increased, and when the driving time is shortened, the supply amount of toner is decreased.

When the driving speed of the toner supplying roller 231 is variable, the driving speed of the toner supplying roller 231 is changed in the state in which the driving time is fixed, so that the supply amount of toner can be controlled. If the driving speed is accelerated, the supply amount of toner is increased. If the driving speed is decelerated, the supply amount of toner is decreased.

The developing units 20M, 20C and 20K are all provided with components identical to those of the developing device 20Y, except that their toner colors are different from one another, and therefore, their detailed descriptions will be omitted.

Figure 5:
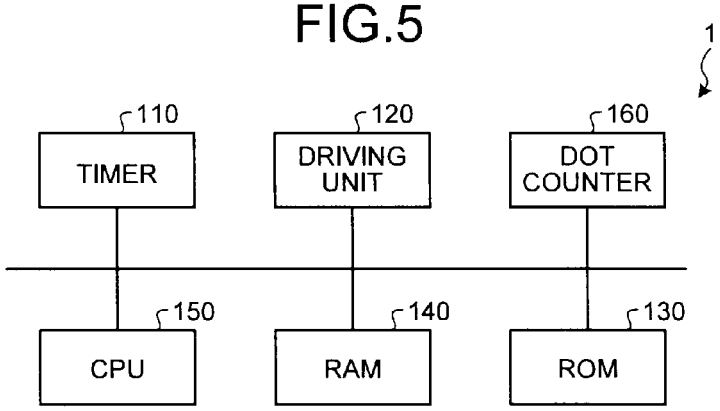
FIG. 5 is a block diagram illustrating an example of an electrical configuration of a printer according to the embodiment.

FIG. 5 is a block diagram illustrating an example of an electrical configuration of the printer 1 according to the embodiment. As illustrated in FIG. 5, the printer 1 is provided with a timer 110, a driving unit 120, a ROM (Read Only Memory) 130, a RAM (Random Access Memory) 140, a CPU (Central Processing Unit) 150 and a dot counter 160. Here, processing of the timer 110, the driving unit 120, the ROM 130, the RAM 140, the CPU 150 and the dot counter 160 will be described with respect to the developing device 20Y. Processing with respect to the developing units 20M, 20C and 20K is identical to that of the developing device 20Y, and therefore, their detailed descriptions will be omitted.

The timer 110 is hardware for counting various times including a driving time required to drive the driving unit, and the like. However, the embodiment is not limited thereto, and the timer 110 may be realized as software.

The driving unit 120 is a driving source of the toner supplying roller 231 in the toner container 23, and is provided with at least one of a motor and a clutch. The CPU 150 which will be described later drives the driving unit 120, so that the toner supplying roller 231 is rotated, and thus the toner is supplied to the developing unit 21 from the toner container 23. The driving unit 120 is provided to each of the developing units 20Y, 20M, 20C and 20K.

The ROM 130 is a non-volatile read only memory, and stores various programs including a replenishment program executed in the printer 1, various pieces of information used in processes performed by the printer 1, or the like.

The RAM 140 is a volatile memory, and serves as a work area of the CPU 150 which will be described later.

The CPU 150 (an example of a control unit) is used to control the entire operation of the printer 1. When the detecting unit 22 detects that the amount of the toner stored in the developing unit 21 is equal to or less than a threshold value, the CPU 150 drives the driving unit 120 for a correction driving time, and supplies the toner from the toner container 23 to the developing unit 21.

If the detecting unit 22 detects that the amount of the toner stored in the developing unit 21 is equal to or less than the threshold value after the toner is supplied from the toner container 23 to the developing unit 21 by driving the driving unit 120 for the correction driving time, the CPU 150 calculates a unit amount of toner supply, which corresponds to an amount of the toner supplied in a case of driving the driving unit 120 for a unit driving time, from the correction driving time and the total amount of toner consumption, which is calculated by the dot counter 160 to be described later. For example, the CPU 150 obtains the unit amount of toner supply by dividing the total amount of toner consumption by the correction driving time. The CPU 150 supplies the toner from the toner container 23 to the developing unit 21 by driving the driving unit 120 on the basis of the calculated unit amount of toner supply. For example, the CPU 150 also calculates a usual driving time to supply a predetermined amount of toner for a usual replenishment, from the calculated unit amount of toner supply, and supplies the toner from the toner container 23 to the developing unit 21 by driving the driving unit 120 for the calculated usual driving time.

The CPU 150 may supply the toner from the toner container 23 to the developing unit 21 by driving the driving unit 120 for the correction driving time, when the detecting unit 22 detects that the amount of toner in the developing unit 21 is equal to or less than the threshold value and when the control unit determines that an amount of toner consumption for a next printing is equal to or more then a predetermined value (a predetermined consumption amount). The amount of toner consumption for the next printing is calculated by the dot counter 160 to be described later, from a printing volume or amount of a target image for the next printing.

Furthermore, the control unit may supply the toner to the developing unit 21 from the toner container 23 by driving the driving unit for the correction driving time, when the detecting unit detects that the amount of the toner stored in the developing unit is equal to or less than the threshold value and when the control unit determines that the number of printing sheets is equal to or more than a predetermined value (the predetermined number of sheets).

Furthermore, the control unit may supply the toner to the developing unit 21 from the toner container 23 by driving the driving unit for the correction driving time, when the detecting unit detects that the amount of the toner stored in the developing unit is equal to or less than the threshold value and when the control unit determines that a time period elapsed from a predetermined time point is equal to or more than a predetermined value (a predetermined time period). The predetermined time point may be a time point when the toner is previously supplied from the toner container 23 to the developing unit 21 by driving the driving unit for the correction driving time.

The dot counter 160 (an example of a calculating unit) is hardware for calculating the amount of toner consumed in the developing by the developing unit 21. However, the embodiment is not limited thereto, and the dot counter 160 may be software. The dot counter 160 calculates the total amount of toner consumption which corresponds to an amount of toner consumed after the completion of toner supply from the toner container 23 to the developing unit 21 by driving the driving unit 120 for the correction driving time until the detecting unit 22 detects that the amount of toner in the developing unit 21 is equal to or less than the threshold value.

The electrostatic latent image on the photosensitive drum 13Y is formed by the irradiation of the laser light LY from the optical scanning unit 30. The electrostatic latent image itself is a group of dots determined on the basis of the print target image to be used to generate the latent image. The toner consumption per one dot can be estimated from various settings at the developing unit 21 (e.g. output power of laser beam or bias), a using environment (e.g. temperature and/or moisture), and a dot forming condition (e.g. information indicating whether dots are continuous (i.e. solid image) or not). Therefore, the dot counter 160 calculates (estimates) the toner consumption, which is to be consumed at the developing unit 21, from a printing amount (printing area) that is a dot quantity of the print target image. Specifically, the dot counter 160 obtains the toner consumption by multiplying the toner consumption per one dot by the printing amount (the number of dots) of the print target image.

Next, an explanation will be made on the operation of the printer according to the embodiment. The explanation will be focused on the developing device 20Y, since the operation with respect to the developing devices 20M, 20C, and 20K is the same as the operation with respect to the developing device 20Y. Thus, the explanation about the operation for the developing devices 20M, 20C, and 20K is omitted.

Figure 6:
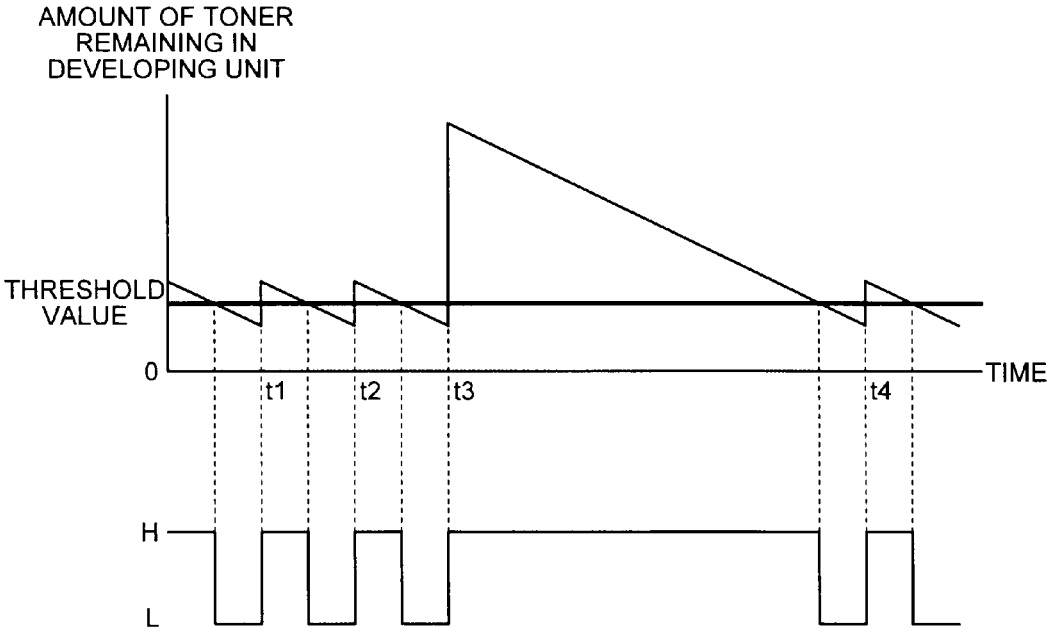
FIG. 6 is a timing chart illustrating an example of toner supply processing performed in the printer according to the embodiment.

FIG. 6 is a timing chart showing an example of the toner supply process implemented by the printer 1 according to the embodiment. In the example of FIG. 6, the vertical axis represents the amount of toner remained in the developing unit, and the horizontal axis represents time. While the amount of toner in the developing unit 21 exceeds the threshold value (i.e. the status is not the so-called "toner end"), the output from the detecting unit 22 (the light receiving element 220*b*) is high (H). While the amount of toner in the developing unit 21 is equal to or less than the threshold value (i.e. the status is the "toner end"), the output from the detecting unit 22 (the light receiving element 220*b*) is low (L).

In the example of FIG. 6, a predetermined amount of toner for a usual supply is supplied at the timings t1, t2 and t4 in the toner end status. On the other hand, an amount of toner for correcting a unit amount of toner supply is supplied at the timing t3 in the toner end status, so that the unit amount of toner supply is corrected. The amount of toner for correcting the unit amount of toner supply is larger than the amount of toner for the usual supply. This means that the driving time of the driving unit 120 when the unit amount of toner supply is corrected is longer than that of the usual supply. This is for the purpose of reducing any influence from an erroneous reading of the detecting unit 22. At the first toner end timing after the amount of toner for correcting the unit amount of toner supply is supplied at the timing t3, the unit amount of toner supply is corrected. When the usual supply is conducted at the timing t4, a predetermined amount of toner for the usual supply is supplied by driving the driving unit 120 for a usual driving time which is calculated from the corrected unit amount of toner supply.

Figure 7:
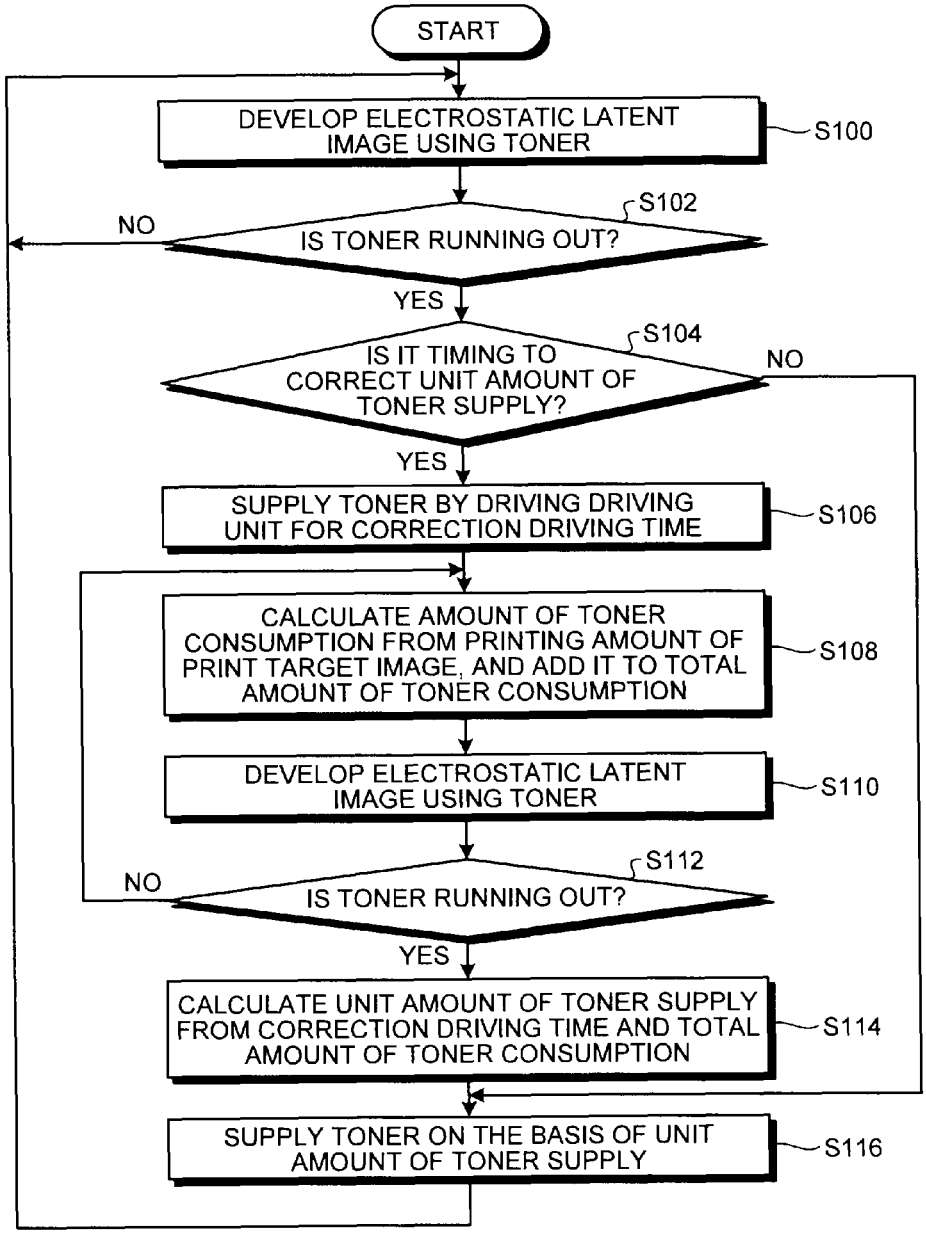
FIG. 7 is a flowchart illustrating an example of the toner supply processing performed in the printer according to the embodiment.

FIG. 7 is a flow chart showing an example of toner supply process implemented by the printer according to the embodiment.

Once the printer 1 starts the printing process or step, the developing unit 21 develops the latent image formed on the photosensitive drum 13Y by using the toner in the developing unit 21 (step S100).

Next, the CPU 150 determines whether the status is the toner end, i.e. whether the detecting unit 22 detects whether the amount of toner in the developing unit 21 is equal to or less than the threshold value (step S102). If the status is not the toner end (NO at the step S102), the printer 1 starts the next printing and the developing unit 21 performs the step S100.

On the other hand, if the status is the toner end (YES at the step S102), the CPU 150 determines whether it is the timing to correct the unit amount of toner supply (step S104). For example, the CPU 150 determines whether an amount of toner consumption for the next printing is equal to or more than a predetermined value (predetermined amount of consumption), whether the number of printing sheets is equal to or more than a predetermined value (predetermined number of sheets), or whether the time period elapsed from a predetermined time point is equal to or more than a predetermined value (predetermined time period).

If it is the timing to correct the unit amount of toner supply (YES at the step S104), i.e. it is the timing t3 in FIG. 6, the CPU 150 supplies the toner from the toner container 23 to the developing unit 21 by driving the driving unit 120 for a correction driving time (step S106).

When the printer 1 starts the next printing after the toner supply to the developing unit 21 is completed, the dot counter 160 calculates the amount of toner consumption from the printing amount of the print target image, and adds the calculated amount to the total amount of toner consumption (step S108). Incidentally, at a time point when the toner supply to the developing unit 21 is completed, the total amount of toner consumption is zero.

Next, the developing unit 21 develops the latent image formed on the photosensitive drum 13Y by using the toner in the developing unit 21 (step S110).

Until the status becomes the toner end (NO at the step S112), the dot counter 160 and the developing unit 21 repeats the steps S108 and S110, respectively.

Next, if the status becomes the toner end (YES at the step S112), the CPU 150 calculates an unit amount of toner supply which corresponds to an amount of toner supplied in a case of driving the driving unit 120 for a unit driving time, from the total amount of toner consumption and the correction driving time (step S114). For example, the CPU 150 obtains the unit amount of toner supply by dividing the total amount of toner consumption by the correction driving time.

Next, the CPU 150 supplies the toner from the toner container 23 to the developing unit 21 by driving the driving unit on the basis of the calculated unit amount of toner supply (step S116). Namely, the CPU 150 supplies the toner from the toner container 23 to the developing unit 21 at the timing t4 in FIG. 6 by driving the driving unit 120 on the basis of the unit amount of toner supply calculated at the step S114. Then, the process goes back to the step S100.

On the other hand, if it is not the timing to correct the unit amount of toner supply at the step S104 (NO at the step S104), i.e. at the timings t1, t2 in FIG. 6, the CPU 150 supplies the toner from the toner container 23 to the developing unit 21 by driving the driving unit 120 on the basis of the unit amount of toner supply calculated previously (step S116). Namely, the CPU 150 supplies the toner from the toner container 23 to the developing unit 21 at the timings t1 and t2 in FIG. 6 by driving the driving unit 120 on the basis of the unit amount of toner supply already calculated. Then, the process goes back to the step S100.

As described above, in the embodiment, the unit amount of toner supply which corresponds to an amount in the case of driving the driving unit for the unit driving time is calculated from the correction driving time and the amount of toner consumption, and the toner is supplied on the basis of the calculated unit amount of toner supply. Therefore, according to the embodiment, it is possible to supply the toner taking account of or reflecting the variations or differences among the products such as the toner supplying unit or the driving unit. Thus, a required amount of toner can be supplied accurately. As a result, the amount of toner remained in the developing unit can be maintained within a certain range, resulting in the improved image quality.

Hardware Configuration

Figure 8:
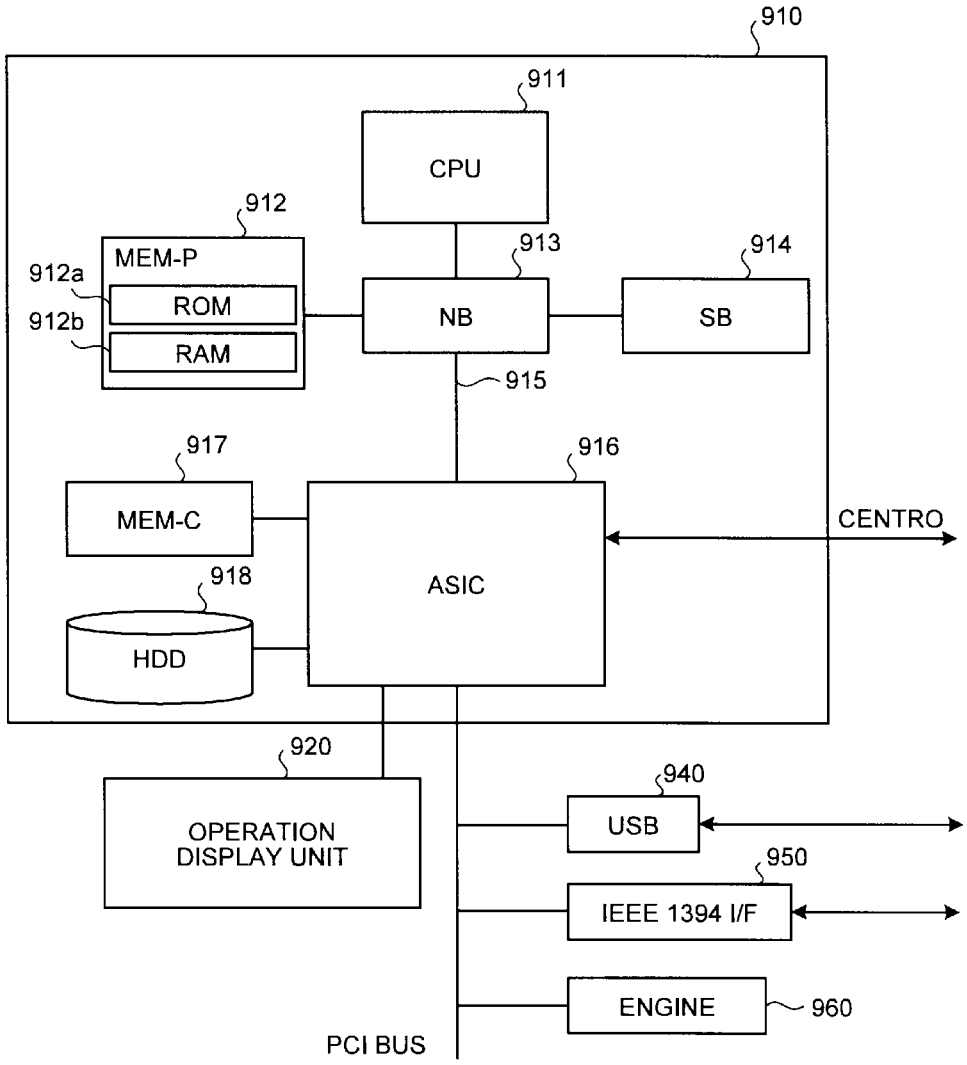
FIG. 8 is a block diagram illustrating an example of a hardware configuration of the printer according to the embodiment.

FIG. 8 is a block diagram illustrating an example of a hardware configuration of the printer according to the embodiment. As illustrated in FIG. 8, the printer according to the embodiment is connected to a controller 910 and an engine 960 through a PCI (Peripheral Component Interconnect) bus. The controller 910 controls an entire operation of the MFP, drawing, communication, and an input from the operation display unit 920. The engine 960 may be a printer engine or the like accessible to the PCI bus, such as a black and white plotter, a one-drum color plotter, a four-drum color plotter, a scanner, or a fax unit. The engine 960 includes an image processing unit such as error diffusion processing unit or gamma conversion processing unit in addition to the so-called engine unit such as a plotter.

The controller 910 includes a CPU 911, a north bridge (NB) 913, a system memory (MEM-P) 912, a south bridge (SB) 914, a local memory (MEM-C) 917, an ASIC (Application Specific Integrated Circuit) 916 and a hard disk drive (HDD) 918. The NB 913 and the ASIC 916 are connected through an AGP (Accelerated Graphics Port) bus 915. The MEM-P 912 further includes a ROM 912*a* and a RAM 912*b*.

The CPU 911 performs the entire control of the printing apparatus, and has a chip set including the NB 913, the MEM-P 912 and the SB 914. The CPU 911 is connected to another device with the chip set interposed therebetween.

The NB 913 is a bridge for connecting the CPU 911, the MEM-P 912, the SB 914 and the AGP bus 915, and has a memory controller for controlling reading and writing from/to the MEM-P 912, a PCI master and an AGP target.

The MEM-P 912 is a system memory used as a memory for storing a program or data, a memory for developing a program or data, a drawing memory in a printer, or the like. The MEM-P 912 has the ROM 912*a* and the RAM 912*b*. The ROM 912*a* is a read only memory used as a memory for storing a program or data. The RAM 912*b* is a writable and readable memory used as a memory for developing a program or data, a drawing memory of a printer, or the like.

The SB 914 is a bridge for connecting the NB 913, a PCI device and a peripheral device. The SB 914 is connected to the NB 913 through the PCI bus, and a network interface (I/F) and the like are connected to the PCI bus.

The ASIC 916 is an IC (Integrated Circuit) dedicated to image processing, which has a hardware component for image processing, and serves as a bridge for connecting each of the AGP bus 915, the PCI Bus, the HDD 918 and the MEM-C 917. The ASIC 916 includes a PCI target, an AGP master, an arbiter (ARB) that is a core of the ASIC 916, a memory controller for controlling the MEM-C 917, a plurality of DMACs (Direct Memory Access Controllers) for performing rotation of image data using a hardware logic, and a PCI unit for performing data transmission to the engine 960 with the PCI bus interposed therebetween. The ASIC 916 is connected to a USB (Universal Serial Bus) 940 and an IEEE 1394 (the Institute of Electrical and Electronics Engineers 1394) interface 950 through the PCI bus. The operation display unit 920 is directly connected to the ASIC 916.

The MEM-C 917 is a local memory used as an image buffer for copying or a coding buffer, and the HDD 918 is a storage for performing storage of image data, storage of program, storage of font data and storage of forms.

The AGP bus 915 is a bus interface for a graphic accelerator card, which is proposed to perform graphic processing at a high speed. The AGP bus 915 is used to operate a graphic acceleration card at a high speed by directly accessing the MEM-P 912 with a high throughput.

Modification

The present invention is not limited to the aforementioned embodiments, and may be variously modified. For example, in the aforementioned embodiments, the toner having the same amount as that of the toner consumed may be supplied not when the residual amount of toner is equal to or less than a threshold value but whenever the toner is consumed.

According to the present invention, a desired amount of toner can be supplied with high accuracy.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrying body on which an electrostatic latent image is formed;

a developing unit that stores toner to develop the electrostatic latent image formed on the image carrying body by using the toner stored therein;

a detecting unit that detects whether an amount of the toner stored in the developing unit is equal to or less than a threshold value; and a control unit that drives a driving unit for a first toner supply sequence and a second toner supply sequence, wherein the control unit drives the driving unit, for the first toner supply sequence, to supply the toner to the developing unit from a toner supplying unit when the detecting unit detects that the amount of the toner stored in the developing unit is equal to or less than the threshold value, and wherein the control unit drives the driving unit, for the second toner supply sequence for a correction driving time, when a predetermined condition is satisfied; and a calculating unit that calculates an amount of toner consumption from when the toner is supplied to the developing unit by the second toner supply sequence to a subsequent detection that the amount of the toner stored in the developing unit is equal to or less than the threshold value, wherein the control unit calculates a unit amount of toner supply which corresponds to an amount supplied in a case of driving the driving unit for a unit driving time, from the correction driving time and the amount of toner consumption, and wherein the control unit drives the driving unit for the first toner supply sequence on the basis of the calculated unit amount of toner supply.

2. The image forming apparatus according to claim 1, wherein the control unit supplies the toner to the developing unit from the supplying unit by driving the driving unit for the correction driving time, when the detecting unit detects the predetermined condition which is the amount of the toner stored in the developing unit is equal to or less than the threshold value and when the control unit determines that an amount of toner consumption for a next printing is equal to or more than a predetermined value.

3. The image forming apparatus according to claim 1, wherein the control unit supplies the toner to the developing unit from the supplying unit by driving the driving unit for the correction driving time, when the detecting unit detects the predetermined condition which is the amount of the toner stored in the developing unit is equal to or less than the threshold value and when the control unit determines that a number of printing sheets is equal to or more than a predetermined value.

4. The image forming apparatus according to claim 1, wherein the control unit supplies the toner to the developing unit from the supplying unit by driving the driving unit for the correction driving time, when the detecting unit detects the predetermined condition which is the amount of the toner stored in the developing unit is equal to or less than the threshold value and when the control unit determines that a time period elapsed from a predetermined time point is equal to or more than a predetermined value.

5. The image forming apparatus according to claim 1, wherein the driving unit includes at least one of a motor and a clutch.

6. A toner supplying method comprising:

developing an electrostatic latent image formed on an image carrying body by using toner stored in a developer;

detecting whether an amount of the toner stored in the developer is equal to or less than a threshold value;

firstly supplying the toner to the developer from a toner supply by driving a driver, when the detecting detects that the amount of the toner stored in the developer is equal to or less than the threshold value;

secondly supplying the toner to the developer from the toner supply by driving the driver for a correction driving time, when a predetermined condition is satisfied; and calculating an amount of toner consumption from when the toner is supplied to the developer by the second supplying to a subsequent detection that the amount of the toner stored in the developer is equal to or less than the threshold value.

7. A computer program product comprising a non-transitory computer-readable medium having computer-readable program codes embedded therein for controlling a toner supplying by a computer, the program codes when executed causing the computer to execute:

developing an electrostatic latent image formed on an image carrying body by using toner stored in a developer;

detecting whether an amount of the toner stored in the developer is equal to or less than a threshold value;

firstly supplying the toner to the developer from a toner supply by driving a driver, when the detecting detects that the amount of the toner stored in the developer is equal to or less than the threshold value;

secondly supplying the toner to the developer from the toner supply by driving the driver for a correction driving time, when a predetermined condition is satisfied; and calculating an amount of toner consumption from when the toner is supplied to the developer by the second supplying to a subsequent detection that the amount of the toner stored in the developer is equal to or less than the threshold value.

* * * * *